US005148915A

United States Patent [19]

Ryan

[11] Patent Number: 5,148,915

[45] Date of Patent: Sep. 22, 1992

[54] GOLF BAG COMPARTMENTALIZER

[76] Inventor: Daniel P. Ryan, 32 Hamilton Rd., No. 402, Arlington, Mass. 02174

[21] Appl. No.: 753,117

[22] Filed: Aug. 30, 1991

[51] Int. Cl.[5] ..... A63B 55/00

[52] U.S. Cl. ..... 206/315.6; 206/315.3

[58] Field of Search ..... 206/315.2-315.7

[56] References Cited

U.S. PATENT DOCUMENTS

| | | | |
|---|---|---|---|
| 1,092,729 | 4/1914 | Low et al. | 206/315.6 X |
| 1,227,657 | 5/1917 | Pierce | 206/315.6 |
| 1,798,638 | 3/1931 | Stone et al. | 206/315.6 |
| 2,256,521 | 9/1941 | Kirkpatrick et al. | 206/315.4 X |
| 2,325,474 | 7/1943 | Cart | 206/315.7 |
| 2,546,416 | 3/1951 | Alter et al. | 206/315.6 |
| 2,595,987 | 5/1952 | Shears | 206/315.6 |
| 3,842,876 | 10/1974 | Cristelli | 206/315.6 X |
| 4,155,387 | 5/1979 | Costa | 206/315.6 |
| 4,172,484 | 10/1979 | Henning | 206/315.6 |
| 4,311,178 | 1/1982 | Kennedy | 206/315.6 |
| 4,691,823 | 9/1987 | Pape | 206/315.6 |
| 4,881,638 | 11/1989 | Cho | 206/315.3 |
| 4,911,392 | 3/1990 | Airey, Jr. | 206/315.4 X |
| 4,932,523 | 6/1990 | Yamazoe | 206/315.4 X |
| 4,938,349 | 7/1990 | Burns | 206/315.6 |

FOREIGN PATENT DOCUMENTS

| | | | |
|---|---|---|---|
| 1479 | of 0000 | United Kingdom | 206/315.5 |
| 705115 | 10/1954 | United Kingdom | 206/315.5 |
| 1418463 | 12/1975 | United Kingdom | 206/315.5 |

*Primary Examiner*—Sue A. Weaver

*Attorney, Agent, or Firm*—Francis J. Caufield

[57] ABSTRACT

This invention is a lightweight, inexpensive insert for partitioning the interior space of a conventional golf bag into separate compartments for storing one or more golf clubs so that they will not bind when transferring them to and from the bag. The insert is made of a durable, high strength cloth or fabric such as nylon or equivalent material and is suspended from the dividing bars of the bag by flaps and hook and loop materials while its bottom, in a preferred form, is retained in place via a base plate which provides resistance to turning and lateral movement.

8 Claims, 4 Drawing Sheets

GOLF BAG COMPARTMENTALIZER

BACKGROUND OF THE INVENTION

1. Field of the Invention

This invention, in general, relates to golf bags and, in particular, to a lightweight insert for use in partitioning a golf bag into a plurality of separate compartments in which one or more golf clubs can be stored and transported.

2. Description of the Prior Art

Golfers using bags of conventional design are often irritated when removing or returning clubs to the bag. With the conventional bag, club handles bind at the bottom of the bag, making them difficult to remove, and jam when upon their return. Along with the irritation factor, this problem also leads to excessive and unnecessary wear of the club handles.

Expensive golf club bags avoid this problem with a larger bag diameter thus providing more room, and/or provide full length dividers which compartmentalize the bag into three or four separate compartments. However, the penalty for this luxury is higher price and weight.

Another available solution uses plastic tube inserts which are placed in the bag. Here, each club goes into an individual tube. However, this solution is not always adequate because, in many instances, clubs bind to the edge of the tube resulting in the tube partially coming out along with the club as it is removed. For those who wish to carry, the tubes also add unwanted weight.

Various other attempts at golf bag compartmentalization have been proposed to solve the foregoing problems as evidenced in the patent literature as, for example, in U.S. Pat. Nos. 4,881,638 to S. C. Cho; 4,691,823 to K. R. Pape; 4,155,387 to R. Costa; and 1,798,638 to J. O. Stone et al. However, there is still a need for an inexpensive, lightweight and viable solution to this problem, and it is a primary object of the present invention to provide such a solution.

Other objects of the invention will, in part, appear hereinafter and, in part, be obvious. A full understanding of the invention will be had from the detailed description to follow when read in connection with the accompanying drawings.

SUMMARY OF THE INVENTION

This invention is a lighweight, inexpensive insert for partitioning the interior space of a conventional golf bag into separate compartments for storing one or more golf clubs so that they will not bind when transferring them to and from the bag. The insert is made of a durable, high strength cloth or fabric such as nylon or equivalent material. It is suspended from the dividing bars of the bag by flaps and hook and loop materials while its bottom, in one preferred form, is retained in place via a base plate which provides resistance to turning and lateral movement.

The inventive insert can compartmentalize the standard, inexpensive golf bag into three, four, or even more sections while still being easy to install. While held around the top dividers, it is held down by golf clubs placed in the bag. While the main purpose is to improve for ease of inserting and extracting a golf club from the bag, additional benefits are reduced wear of club handles, elimination of the need for plastic tubes thereby reducing the weight of the bag for ease and comfort during transport.

An alternative means of securing the base of the insert to the standard bag involves the use of hook and loop materials one of which has a double sided adhesive.

BRIEF DESCRIPTION OF THE DRAWINGS

The structure and operation of the invention together with other objects and advantages thereof may best be understood by reading the detailed description to follow in connection with the drawings wherein parts are identified by a unique reference numeral wherever they appear in the drawings and wherein.

DETAILED DESCRIPTION

Figure 1:
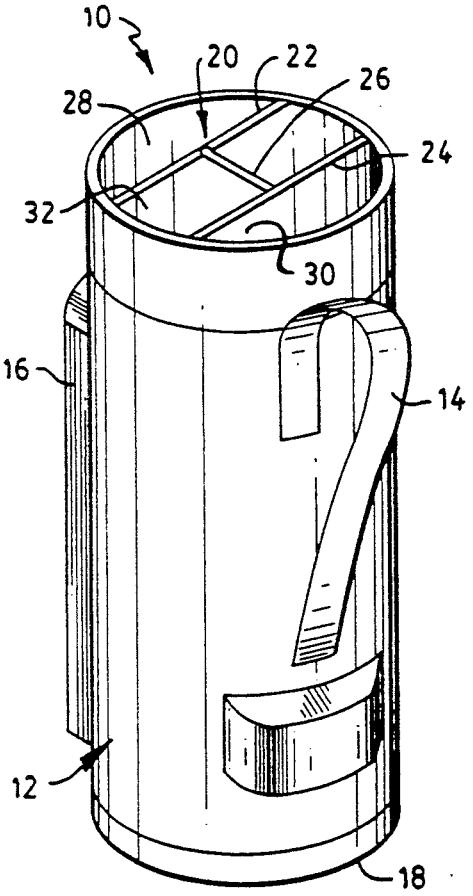
FIG. 1 is a diagrammatic perspective of a conventional golf bag in which the present invention can be inserted to partition its interior space into separate compartments for storing golf clubs.

The present invention is a lightweight insert for use in dividing the interior space of a conventional, inexpensive golf bag of a type that is widely used and readily available in the marketplace. Such a conventional golf bag is illustrated in FIG. 1 at 10. As can be seen, bag 10 comprises an elongated body in the form of a hollow tube 12 that is generally cylindrical shaped and whose standard length is, within tolerance, approximately 33 inches. A carrying strap 14 is attached on one side of the outside surface of bag 10, and opposite strap 14, is a compartment 16 for storing articles of clothing, extra balls, tees, and other accessories a golfer may find useful or necessary for playing.

The bottom end of bag 10 is closed with a base 18 while its top end remains open. The open top end is designated at 20 in FIG. 1. Across open end 20 are divider bars 22, 24, and 26. Bars 22 and 24 run parallel to one another, typically spaced 2 to 2-½ inches apart, and bar 26 runs perpendicular to bars 22 and 24, equally dividing the space between them. With this typical dividing bar arrangement, open end 20, which is typically 6-½ to 7-½ inches in diameter for smaller bags and 8 to 8-½ inches for larger diameter bags, is partitioned into four sections shown at 28, 30, 32 and 34. Sections 28, 30, 32 and 34 operate to separate the heads of golf clubs when they are inserted in bag 10. However, while golf club heads can be kept separated at open end 20, their handles easily become entangled at the bag's base 18 thus causing binding which makes it difficult to remove clubs or jamming when attempting to insert them. In addition, binding causes excessive handle wear, which is also obviously undesirable.

Figure 2:
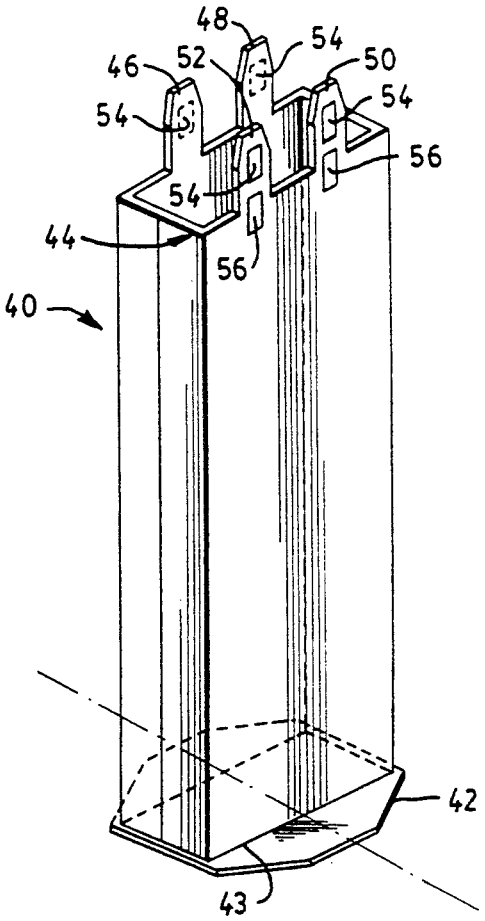
FIG. 2 is a diagrammatic perspective of a preferred embodiment of the golf bag insert of the present invention.

The solution to the foregoing problems is provided by the inventive golf bag insert shown in FIG. 2 at 40. Insert 40 is made of thin, flexible, low-stretch fabric such as nylon or its equivalent to provide it with strength and wear resistance while at the same time allowing it to be fabricated with sewing techniques. The length of insert 40 is preferably made slightly shorter than that of bag 10 for reasons which will become apparent.

Insert 40 also has a closed bottom which terminates in an octagonal shaped base 42 and an open top end 44 whose geometry is slightly smaller than but similar to the generally rectangular partition formed in bag open end 20 between divider bars 22 and 24 and the periphery of the open end 20 between divider bars 22 and 24.

Figure 3:
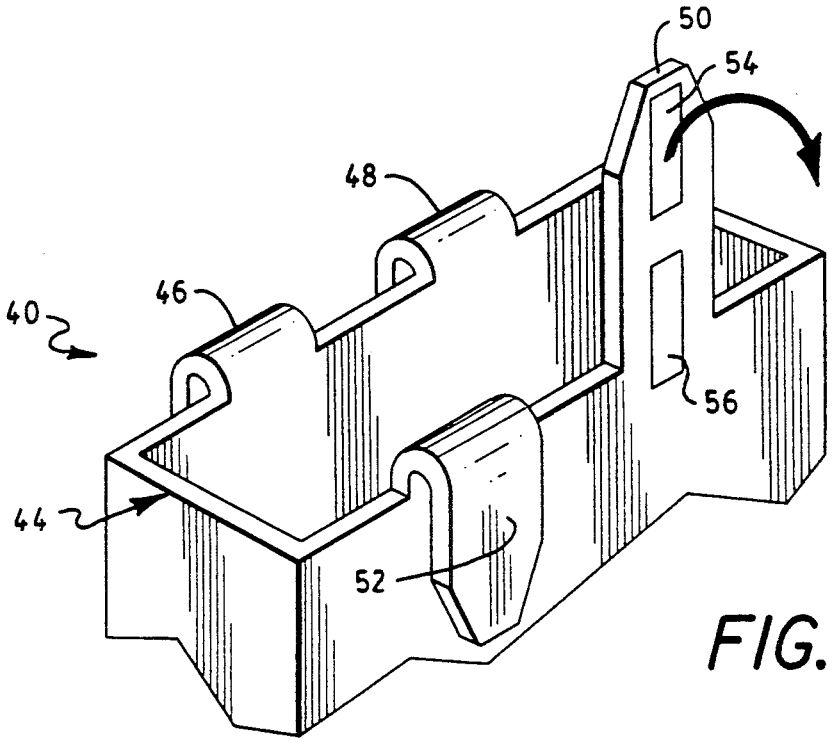
FIG. 3 is an enlarged, diagrammatic perspective view of a portion of the insert of FIG. 2.
Figure 5:
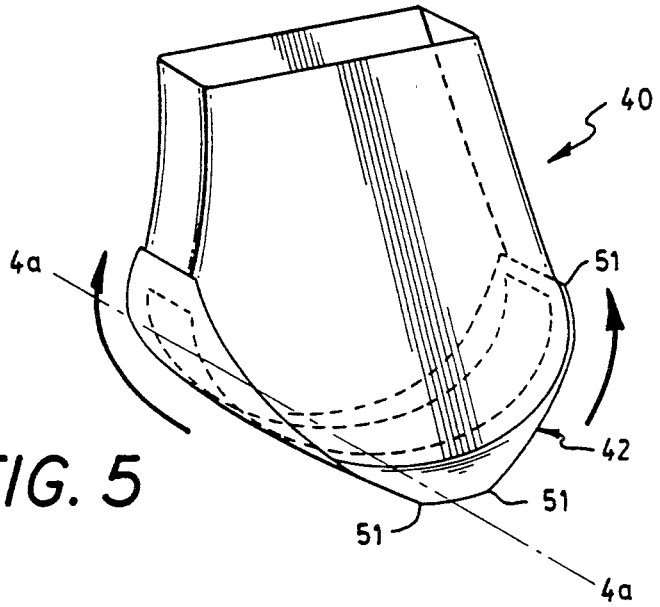
FIG. 5 is a diagrammatic perspective view showing how the base of FIG. 4 can be curled up in preparation for insertion into the bag of FIG. 1.
Figure 6:
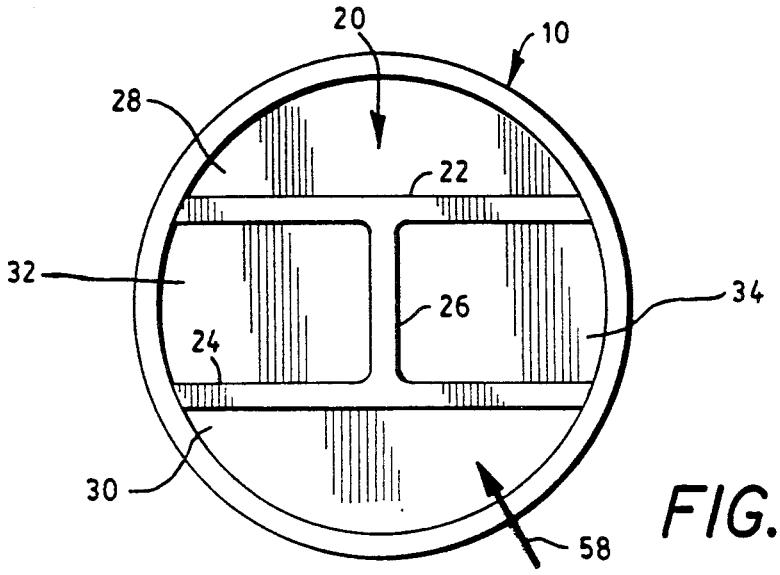
FIG. 6 is an enlarged, plan view showing the top opening and divider bars of the golf bag of FIG. 1.
Figure 7:
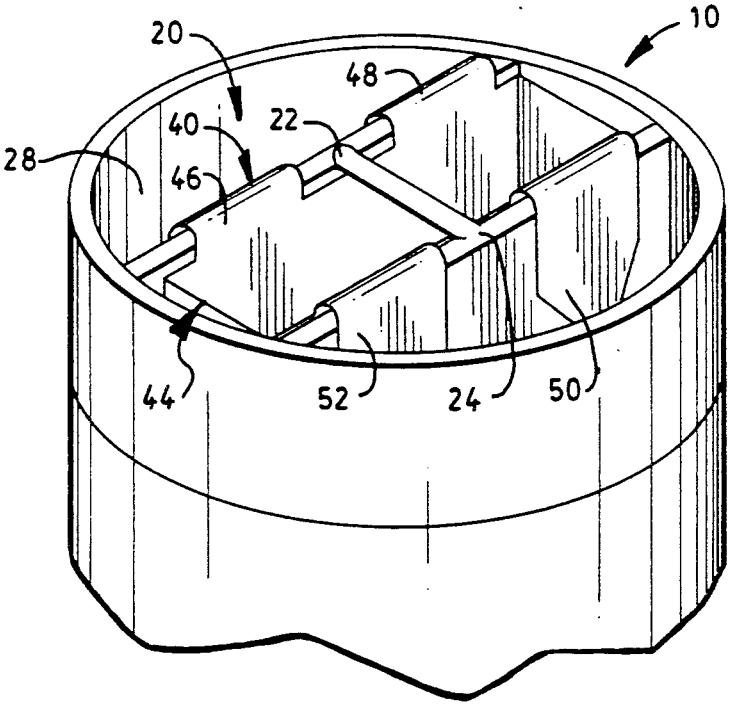
FIG. 7 is a diagrammatic perspective view showing the top portion of the insert of FIG. 2 suspended from the divider bars of the golf bag of FIG. 1.

Extending from open end 44 are four flaps 46, 48, 50, and 52. On each flap, 46, 48, 50 and 52, there is provided a strip of hook material typically shown at 54 (See also FIG. 3) and for each strip of hook material 54 there is provided a corresponding strip of loop material designated generally at 56 in the Figures. As shown in FIGS. 3 and 7, flaps 46, 48, 50 and 52 are folded over divider bars 22 and 24 with the strips of hook material 54 attached to each corresponding strip of loop material 56. The lengths of the flaps 46, 48, 50, and 52 that of strips of hook material 54 and loop material 56, and the length of insert 40, accounting for the thickness of base 42, are selected so that, when insert 40 is placed in bag 10 and golf clubs are inserted, flaps 46, 48, 50, and 52 can be wrapped around divider bars 22 and 24, to place the nylon fabric of insert 40 in tension so that it can retain its shape along the length of bag 10. To assist in assuring that this occurs, base 42 is provided with its octagonal shape and is otherwise made of a material that is of high friction. In addition, base 42 bends more easily in one direction than another perpendicular to it, all of which is best understood by now referring to FIG. 4. The base material is a bidirectional material and has been specifically directionally cut so that the base 42 will bend more easily around centerline 4a-4a. This property allows the base 42 to be easily curled up about 4a-4a as shown in FIG. 5 so that it will easily fit through any one of the sections (28, 30, 32, 34) formed in bag open end 20 as illustrated in FIG. 6 by large arrow 58. The additional stiffness of the material along centerline 4a-4a is required to maintain the insert's nominal position. In addition, it is otherwise made of a material and dimensioned so that it will not buckle as a column, thus providing it stiffness in compression along 4a-4a and 4b-4b. This is sufficient to retain the bottom of insert 42 in the center of the bottom of bag 10 resisting any lateral movement away from its nominal position. In addition, the octagonal shape of base 42 resists any moments placed on it tending to twist it away from intended position with the rectangular shape of insert 40 aligned with the aforementioned rectangular shape formed in bag open end 20 between divider bars 22 and 24. Thus, base 42 keeps the bottom of insert 40 centered side-to-side in the bottom of bag 10 while also having a shape designed to resist any twisting of insert 40 about its longitudinal axis extending from the top to the bottom of bag 10.

To assist in the foregoing, base 42 is preferably made of a material which has a moderately high coefficient of friction to further enhance resistance to twisting and, in addition, is preferably water resistant so that none of its properties are degraded in the presence of moisture. A material that has been found to be suitable for the foregoing purposes is one used in the shoe industry and marketed by United Shoe under its registered tradename Texon Springflex ®. This particular material also inherently has bidirectional bending properties which allow it to bend more readily about axis 4a-4a than about axis 4b-4b.

Figure 4:
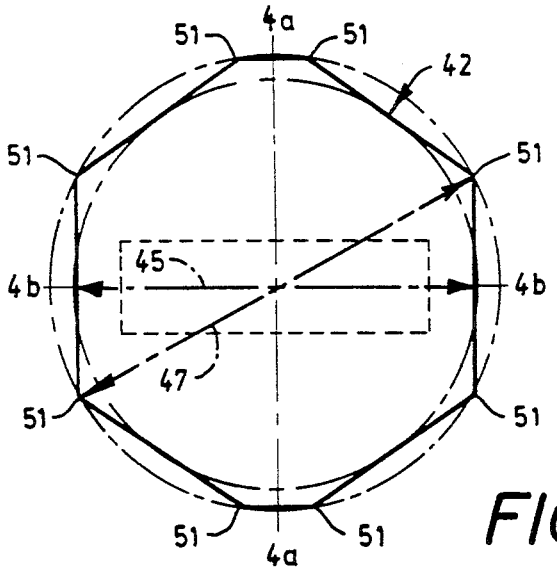
FIG. 4 is a diagrammatic plan view of the base of the insert of FIG. 2.

As FIG. 4 shows, the sides of the base 42 are not equal. This is done to provide ease of installation while also providing a means to create a tight interference fit of the insert base 42 wherever it comes into contact with the base of the golf bag 18, particularly near its side walls. During installation, and after the base 42 has been put through one of the open sections (28, 30, 32 and 34), the base 42 must easily slide down the inside of the golf bag 10. Thus, the sides along 4a-4a are intentionally narrow to allow for this installation. When base 42 is put in final position, however, it must provide for an interference fit. This is provided by the wider sides along 4b-4b and the diagonals formed by the base 42 design as, for example, that shown by the dimension line 47 in FIG. 4.

To account for the variations in diameter of conventional golf bags, the size of base 42 is preferably selected so that it will always be large enough to provide a more or less tight interference fit with the anticipated range of golf bag diameters on the market. As mentioned earlier, the range can be from 6-½ to 7-½ inches. Consequently, as shown in FIG. 4, if the inner circle shown in phantom represents the smallest anticipated diameter and the outer circle the largest, base 42 should be dimensioned such that its sides reach and contact the outer anticipated diameter. For the smaller diameter variety of bags, the distance between the base sides of base 42 as measured along 4b-4b, i.e., dimension 45, is approximately 6-¾ inches and, along the diagonal dimension indicated at 47, it is approximately 7 inches so that the corners of base 42, indicated generally at 51, will touch the sides of the largest anticipated diameter of bag 10, here approximately 7-½ inches. These dimensions can, of course, be made larger to accommodate the larger diameter bags also found on the market. Smaller bag diameters are accommodated by the flexibility of the material of base 42 and any increased interference, which exists under these conditions, further increases the twisting resistance of insert 40.

As further shown in FIG. 4, base 42 and the fabric portions of insert 40, shown by dashed rectangle 43, are sewn together by methods well-known to those skilled in the art.

Figure 8:
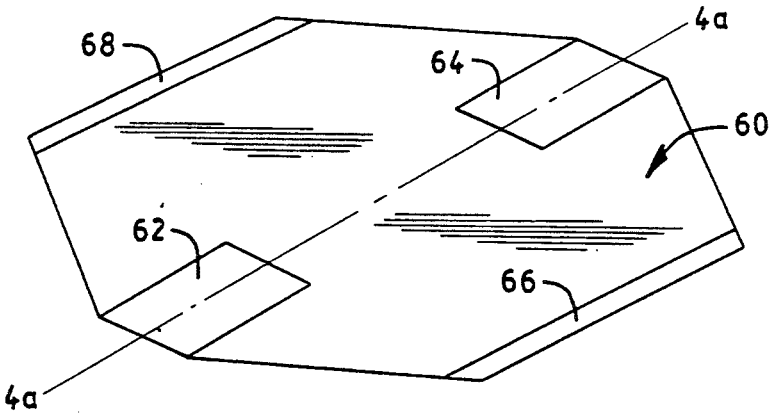
FIG. 8 is a diagrammatic perspective view of an alternate base for use with the inventive golf bag insert.

An alternative possibility for the structure of base 42 is shown in FIG. 8 as base 60. Base 60 is of the same geometry and material composition as that of base 42 but has an additional high friction material strips attached to the side of it that contacts the bottom of golf bag 10 to further increase the twisting resistance of insert 40. These are shown at 62, 64, 66, and 68. Strips 62, 64, 66, and 68 may be made of either an open or closed cell, rubbery-like, foam that is attached by hot stamping or other suitable adhesive. Closed cell neoprene sponge has been found suitable, and the method of attachment may also be by way of well-known double-backed adhesive systems provided they are moisture resistant. Strips 62, 64, 66, and 68 also add to the friction at corners 51 when they come into interference with the inside side walls of bag 10.

Figure 9:
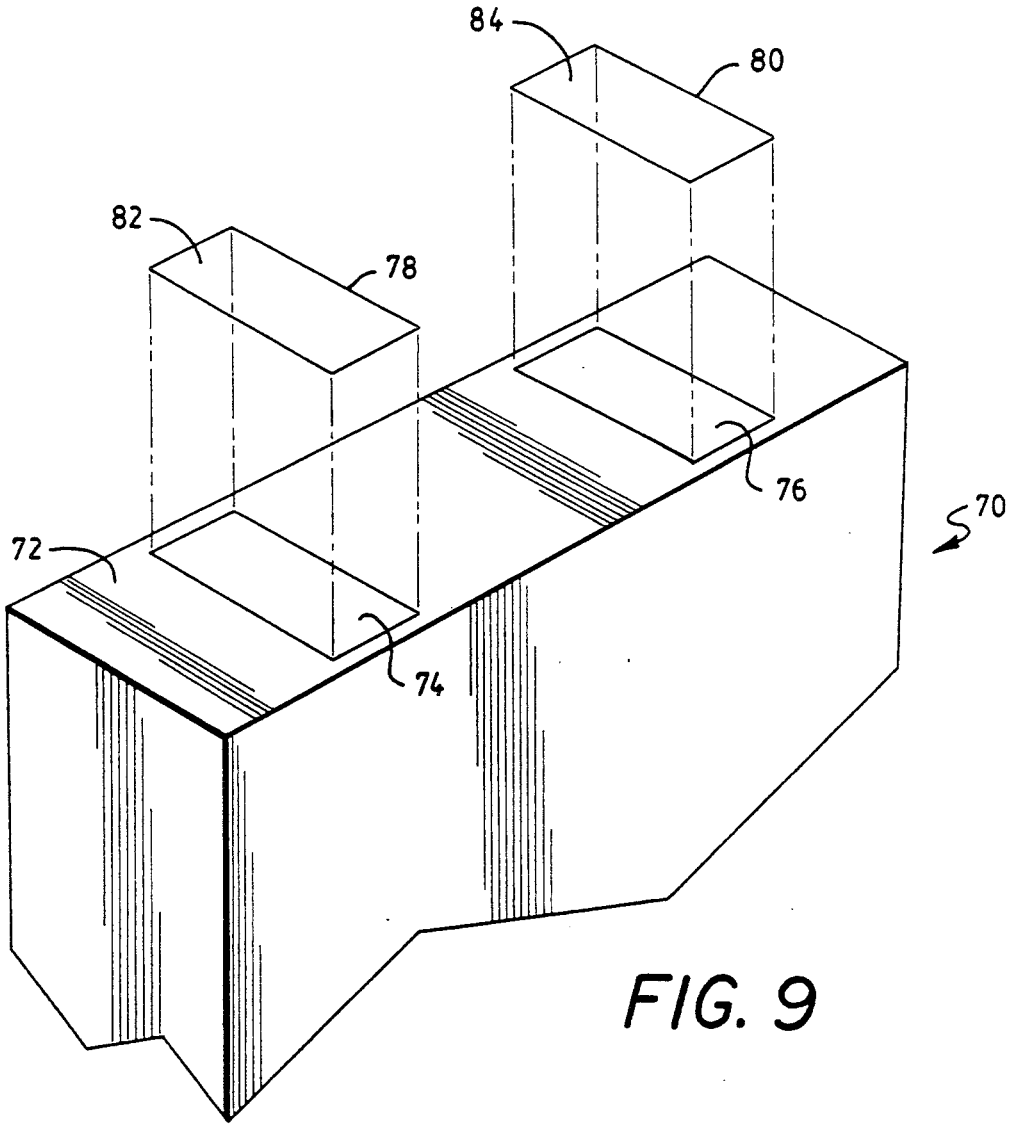
FIG. 9 is a diagrammatic perspective view showing an alternate means for attaching the inventive insert to the bottom of the golf bag of FIG. 1.

An alternative way of attaching the inventive insert to the bottom of bag 10 is illustrated in FIG. 9 where the inventive insert is shown bottom side up at 70. The bottom of insert 70, shown here at 72, is provided with two strips of hook material 74 and 76. Strips 74 and 76, in turn, mate with two corresponding strips of loop material 78 and 80, respectively. Loop strips 78 and 80 are provided with well-known, water-resistant, hot stamped adhesive sides 82 and 84 that are temporally protected by thin removable coverings (not shown) until they are exposed for use. In use the bottom of golf bag 10 is thoroughly cleaned, adhesive sides 82 and 84 are exposed and bottom 72 is centered in the bottom of bag 70 and appropriately aligned in place by tamping it down with a golf club handle or the like until it is firmly adhered. Then, the flaps are attached as before to divider bars 22 and 24 as illustrated in FIG. 7.

In using any of the embodiments of the inventive golf bag inserts, it is recommended to try to replace each club back to its designated compartment to avoid overcrowding any one compartment. Clubs should be removed and inserted when bag 10 is in its upright position. For best results, storage of excess clothing and accessories in the side compartments of the golf bag 10 should be kept to a minimum.

Other variations and changes will be obvious to those skilled in the art without departing from the scope of its teachings. For example, it should be obvious that the inventive insert itself can have one or more partitions thus providing a means for further subdividing a golf bag in more finely separated compartments. In addition, it should also be apparent that the position of the hook and loop strips are interchangeable, and the placement of flaps carrying the hook or loop material can be altered to accommodate divider bar arrangements other than those that are strictly of two parallel bars. For instance, "H"-types, or extended "H"-types, or truncated "Y"-types, such as those marketed under the trademark Ping®, also come within the teachings of the invention. Therefore, it is intended that the embodiments shown herein be considered illustrative and not in a limiting sense.

What is claimed is:

1. An insert for use in partitioning a golf club bag of given length into separate lengthwise compartments for storing and transporting golf clubs where the golf club bag is of the type that has a bottom end, an open top end, sides extending between the bottom end and open top end, and divider bars extending across its open top end, said insert comprising:

an elongated bag of predetermined cross-sectional shape and length where said predetermined length of said elongated bag is shorter than said given length of said golf club bag, said elongated bag being made of fabric and having a closed bottom end and an open top end, said open top end of said elongated bag having a plurality of flaps extending upwardly therefrom and each of said flaps having strips of hook and loop material extending outwardly therefrom;

means for holding and positioning said closed bottom end of said elongated bag in predetermined alignment with said bottom end of said golf club bag so that said closed bottom end of said elongated bag resists twisting with respect to said bottom end of said golf club bag, said means for holding and positioning said closed bottom end of said elongated bag comprising a polygonal shaped base attached to said closed bottom end of said elongated bag for aligning it in a predetermined position with respect to said open top end of said golf club bag; and a plurality of strips of hook and loop material positioned around the outside surface of said elongated bag, adjacent to said top open end thereof, and in alignment with said strips of hook and loop material on said flaps so that said flaps can be wrapped around said divider bars of said golf club bag to retain said open top end of said elongated bag in alignment with said open top end of said golf club bag such that said fabric of said elongated bag can be placed in tension to maintain said predetermined shape thereof throughout the length of said golf club bag thereby separating said golf club bag into lengthwise compartments for the storage and transport of clubs.

2. The insert of claim 1 wherein said base is made of a high friction material to resist twisting.

3. The insert of claim 1 wherein said polygonal shaped base comprises two layers one of which is attached to the outside surface of said closed bottom end of said elongated bag and the other of which comprises at least one strip of a high friction material over said one layer for contacting said bottom end and sides of said golf club bag to further resist twisting by creating additonal friction between said polygonal shaped base of said elongated bag and said bottom end of said golf club bag and to enhance interference forces created when the corners of said polygonal shaped base of said elongated bag come into interference contact with said sides of said golf club bag.

4. The insert of claim 1 wherein said polygonal shaped base of said insert is in the form of an octagon having unequal sides to permit said insert to easily be placed into said golf club bag yet bend at the corners of said polygonal shaped base where they come into interference contact with the inside of said sides of said golf club bag.

5. The insert of claim 1 wherein said fabric comprises nylon.

6. The insert of claim 1 wherein said polygonal shaped base comprises a flexible material that is bidirectionally stiff so that it is relatively more bendable along a first axis therethrough than along a second axis perpendicular to said first axis to make it easier to position said insert in said golf club bag and to facilitate holding and positioning said closed bottom end of said elongated bag with respect to said bottom end of said golf club bag.

7. An insert for use in partitioning a golf club bag of given length into separate lengthwise compartments for storing and transporting golf clubs where the golf club bag is of the type that has a bottom end, an open top end, sides extending between the bottom end and open top end, and divider bars extending across its open top end, said insert comprising:

an elongated bag of predetermined cross-sectional shape and length where said predetermined length of said elongated bag is shorter than said given length of said golf club bag, said elongated bag being made of fabric and having a closed bottom end and an open top end, said open top end of said elongated bag having a plurality of flaps extending upwardly therefrom and each of said flaps having strips of hook and loop material extending outwardly therefrom;

means for holding and positioning said closed bottom end of said elongated bag in predetermined alignment with said bottom end of said golf club bag so that said closed bottom end of said elongated bag resists twisting with respect to said bottom end of said golf club bag, said means for holding and positioning said closed bottom end of said elongated bag comprising a plurality of complementary shaped corresponding strips of hook and loop material half of which strips are attached to said closed bottom end of said elongated bag and the remaining half of which are attached with an adhesive to said bottom of said golf club bag; and a plurality of strips of hook and loop material positioned around the outside surface of said elongated bag, adjacent to said top open end thereof, and in alignment with said strips of hook and loop material on said flaps so that said flaps can be wrapped around said divider bars of said golf club bag to retain said open top end of said elongated bag in alignment with said open top end of said golf club bag such that said fabric of said elongated bag can be placed in tension to maintain said predetermined shape thereof throughout said given length of said golf club bag thereby separating said golf club bag into lengthwise compartments for the storage and transport of clubs.

8. An insert for use in partitioning a golf club bag of given length into separate lengthwise compartments for storing and transporting golf clubs where the golf club bag is of the type that has a bottom end, an open top end, sides extending between the bottom end and open top end, and divider bars extending across its open top end, said insert comprising:

an elongated bag having a predetermined cross-sectional shape and length where said predetermined length of said elongated bag is shorter than said given length of said golf club bag, said elongated bag being made of fabric and having a closed bottom end and an open top end;

adjustable means for attaching said open top end of said elongated bag in alignment with said open top end of said golf bag, said adjustable means for attaching comprising a plurality of flaps extending upwardly from said open top end of said elongated bag and a plurality of strips of hook and loop material disposed on said plurality of flaps and around the outside surface of said elongated bag, adjacent said open top end thereof, said plurality of strips of hook and loop material being arranged in complementary pairs on said plurality of flaps and around the outside surface of said elongated bag so that each of said plurality of flaps of said elongated bag can be adjustably wrapped around at least a portion of said divider bars of said golf club bag and be mated with its complementary strip on the outside surface of said elongated bag to retain said open top end of said elongated bag in alignment with said open top end of said golf club bag; and means for holding and positioning said closed bottom end of said elongated bag in predetermined alignment with said bottom end of said golf club bag, said means for holding and positioning said closed bottom end of said elongated bag being attached to said closed bottom end of said elongated bag to hold and position said closed bottom end of said elongated bag so that it resists twisting with respect to said bottom end of said golf club bag and to accept the weight of golf clubs when present in said golf club bag so that, under the influence of said weight of golf clubs, operates to further hold down said closed bottom end of said elongated bag and place said fabric of said elongated bag in tension so that said predetermined shape thereof is maintained throughout said predetermined length of said elongated bag, said means for holding and positioning said closed bottom end of elongated bag in predetermined alignment with said bottom end of said golf club bag being further structured so that said insert is not permanently attached in said golf club bag.

* * * * *